US005609263A

United States Patent [19]

Perchepied

[11] Patent Number: 5,609,263

[45] Date of Patent: Mar. 11, 1997

[54] THREADED BOTTLE CAP

[76] Inventor: Jacques Perchepied, Route des Chataigniers, 76590 Bertreville Saint Quen, France

[21] Appl. No.: 630,887

[22] Filed: Apr. 2, 1996

Related U.S. Application Data

[63] Continuation of Ser. No. 310,530, Sep. 22, 1994, abandoned.

[30] Foreign Application Priority Data

Sep. 22, 1993 [FR] France ..... 93 11475

[51] Int. Cl.[6] ..... B65D 41/34

[52] U.S. Cl. ..... 215/252; 215/344; 215/DIG. 1

[58] Field of Search ..... 215/250, 252, 215/256, 341, 343, 344, 345, 351, DIG. 1

[56] References Cited

U.S. PATENT DOCUMENTS

| | | | |
|---|---|---|---|
| 4,196,818 | 4/1980 | Brownbill | 215/252 |
| 4,220,250 | 9/1980 | Brownbill | 215/DIG. 1 |
| 4,450,973 | 5/1984 | Toeppen | 215/344 X |
| 4,540,102 | 10/1985 | Wiedmer | 215/344 |
| 4,564,112 | 1/1986 | Brewer | 215/252 X |
| 4,666,053 | 5/1987 | Corcoran et al. | 215/252 |
| 4,744,479 | 5/1988 | Schottli | 215/252 |
| 5,107,998 | 4/1992 | Zumbuhl | 215/252 |
| 5,133,471 | 7/1992 | Pujol Almirall | 215/252 X |
| 5,246,125 | 9/1993 | Julian | 215/252 |
| 5,271,512 | 12/1993 | Ekkert | 215/252 |
| 5,397,009 | 3/1995 | Salmon et al. | 215/252 |
| 5,405,032 | 4/1995 | Anderson | 215/252 |
| 5,439,126 | 8/1995 | Brownbill | 215/344 |

FOREIGN PATENT DOCUMENTS 92089445 11/1992 Germany .

*Primary Examiner*—Allan N. Shoap
*Assistant Examiner*—Nathan Newhouse
*Attorney, Agent, or Firm*—Herbert Dubno; Andrew Wilford

[57] ABSTRACT

A cap for a bottle having a tubular neck formed with an external screwthread and terminating at an annular rim surface has a cup-shaped body generally centered on an axis and formed unitarily with an end wall generally perpendicular to the axis. An annular skirt projects axially downward from the end wall and an internal screwthread in the skirt can mate with the screwthread of the bottle neck. A flexible annular web has an outer periphery joined to the skirt adjacent the end wall and an inner periphery secured to a seal ring. The web and seal ring are dimensioned to engage the rim surface when the cap is threaded onto the neck, and an antitamper ring is secured to a lower end of the skirt.

6 Claims, 4 Drawing Sheets

THREADED BOTTLE CAP

CROSS REFERENCE TO RELATED APPLICATIONS

This application is a file-wrapper continuation of application Ser. No. 08/310,530 filed 22 Sep. 1994, abandoned, with a claim to the priority of French application 93 11475 filed 22 Sep. 1993.

FIELD OF THE INVENTION

The present invention relates to a bottle cap. More particularly this invention concerns an internally threaded cap intended to be mounted on an externally threaded mouth of a bottle.

BACKGROUND OF THE INVENTION

It is standard to close a bottle (which term is here intended to cover any recipient intended to hold a fluent material and having a rigid tubular mouth through which the contents pass) by providing its mouth with external threads that can mate with internal threads of a normally cup-shaped cap. The bottle, which is typically made of glass or plastic, can also be formed on its neck with a retaining ridge under which engage elements of an antitamper ring that is secured by frangible webs to the body of the cap. Thus if the cap is removed, these webs will be ruptured to give a clear indication to the consumer that the container has been tampered with.

In order to seal as well as possible it is known to provide the body part of the cap with a seal ring that engages inside the mouth of the bottle neck. Such caps work just fine so long as they are accurately dimensioned with respect to the bottle they are used on. If the tolerances vary somewhat, however, the lip will not seat properly and the cap will leak. Such variations in tolerance can occur depending, for example, on whether the bottle is made of disposable or recyclable PET, or of PVC or glass. Thus the caps must be exactly manufactured depending on the construction and material of the bottle they are to be used on. Any minor variation from tolerances will result in a leak.

It is also possible to provide a nonintegral seal ring as a separate piece in the cap. This construction is more tolerant of a bad fit, but costs considerably more to make and is much harder to recycle.

In another system a one-piece cap has a seal lip that engages axially against the end surface of the bottle mouth. While such a cap is more tolerant of a bad fit, it cannot hold against much pressure. Thus it is not suitable for use, for instance, on a bottle holding a carbonated beverage where internal pressure can be several bar. Furthermore such a lip is frequently fairly fragile so that it can tear or wrinkle during mounting of the cap, producing a site for a leak.

German utility model 9,208,944 describes a cap having an end wall and a skirt projecting axially downward therefrom. The skirt is internally threaded to fit with the external screwthread of the bottle neck and the end wall has a seal ring that ends at an expansion. When this cap is screwed onto a bottle the ring stretches without movement into the bottle mouth which is thus pressed against this ring and the skirt. This cap is fairly good, but is, once again, very sensitive to dimensions in that it must be exactly fitted to the bottle it is used on.

As far as the antitamper ring is concerned, these are frequently left on the bottle in the prior art. When the cap is made of a resin different from that of the bottle, this creates a recycling problem as the ring must be cut off the bottle before it can be recycled. Furthermore it is occasionally possible to remove such a cap without separating it from its antitamper ring, and such caps can often not be installed by fast-acting machinery without damage to the antitamper structure.

OBJECTS OF THE INVENTION

It is therefore an object of the present invention to provide an improved bottle cap.

Another object is the provision of such an improved bottle cap which overcomes the above-given disadvantages, that is which can seal tightly on bottles of somewhat varying dimensions.

A further object is to provide a one-piece antitamper bottle cap that can be installed by fast-acting machinery without damage to the cap or its antitamper ring.

SUMMARY OF THE INVENTION

A cap for a bottle having a tubular neck formed with an external screwthread and terminating at an annular rim surface has according to the invention a cup-shaped body generally centered on an axis and formed unitarily with an end wall generally perpendicular to the axis. An annular skirt projects axially downward from the end wall and an internal screwthread in the skirt can mate with the screwthread of the bottle neck. A flexible annular web has an outer periphery joined to the skirt adjacent the end wall and an inner periphery secured to a seal ring. The web and seal ring are dimensioned to engage the rim surface when the cap is threaded onto the neck, and an antitamper ring is secured to a lower end of the skirt.

Thus with this arrangement the end surface of the rim will engage the web and/or the seal ring to press same against the lower surface of the end wall and form a very tight seal that can hold against considerable pressure. If the bottle rim surface is a little too big or small the cap will still seal perfectly. The cap can be produced as a single piece by molding at a very low unit cost.

According to a feature of the invention the body is further formed with an annular lip projecting axially downward from the end wall immediately adjacent the skirt and engageable with the web. This lip further deforms to press the seal ring and seal web against the rim surface of the bottle, again ensuring excellent sealing.

The antitamper ring in accordance with this invention is formed with a plurality of reinforcement blocks generally equiangularly spaced about the axis. These reinforcement blocks are wedge-shaped and taper away from the end wall. In addition the antitamper ring is formed with a throughgoing slot extending obliquely of the axis and defining a pair of small circumferentially extending webs that rupture when the cap is removed. The oblique orientation of the slot ensures that these two webs are not axially aligned with each other so they do not break on installation, since the cap is traditionally shoved onto the bottle and turned little if at all. The cap is formed with a plurality of relatively weak connecting tongues extending axially between the antitamper ring and the skirt and dimensioned to rupture on removal of the cap. In addition a single relatively strong connecting tongue extends axially between the antitamper ring and the skirt and is dimensioned not to rupture on removal of the cap so that the strong tongue keeps the antitamper ring with the body.

BRIEF DESCRIPTION OF THE DRAWING

The above and other objects, features, and advantages will become more readily apparent from the following description, reference being made to the accompanying drawing in which:

FIGS. 6 and 7 are views like FIGS. 4 and 5, respectively, but showing a differently dimensioned bottle neck.

SPECIFIC DESCRIPTION

Figure 1:
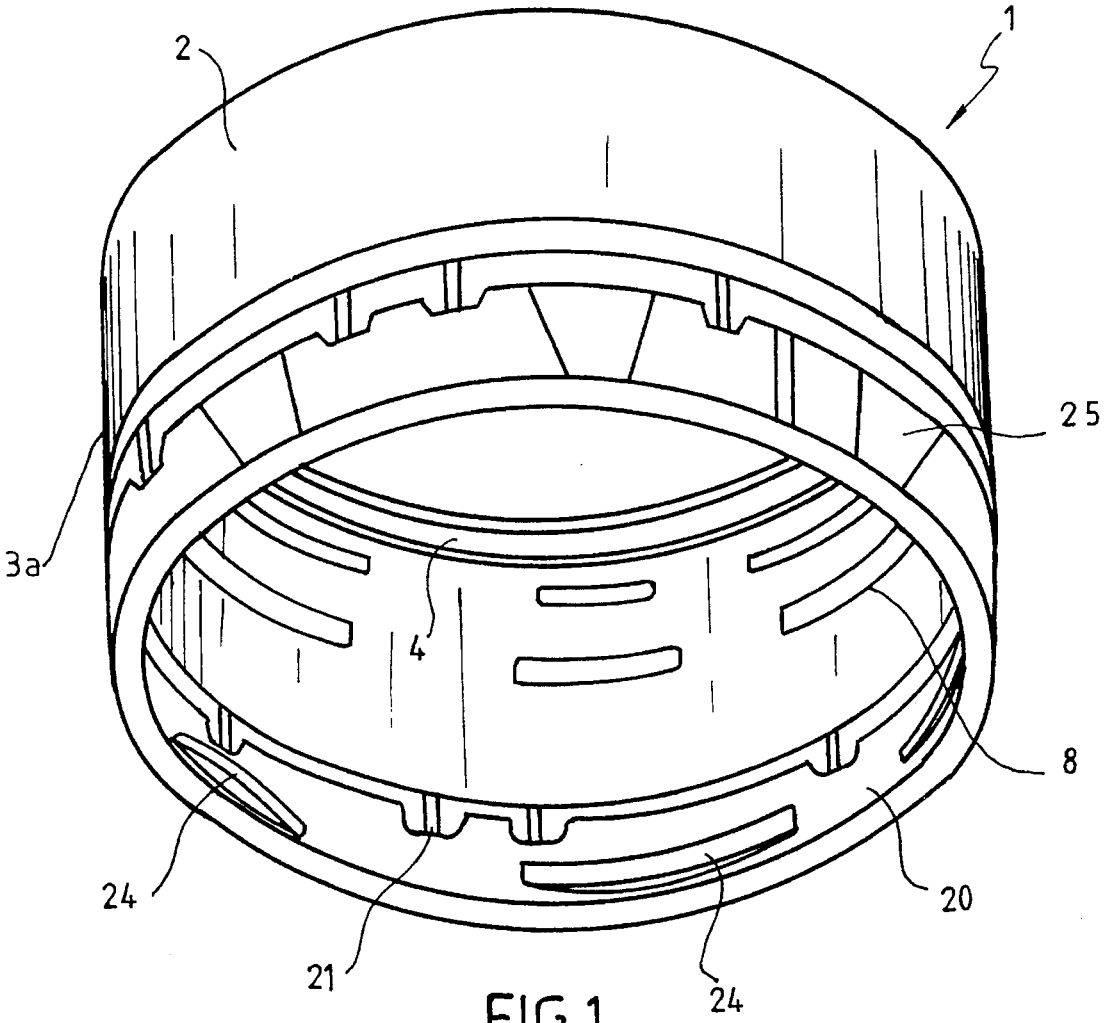
FIG. 1 is a large-scale perspective view of the bottle cap according to the invention.
Figure 3:
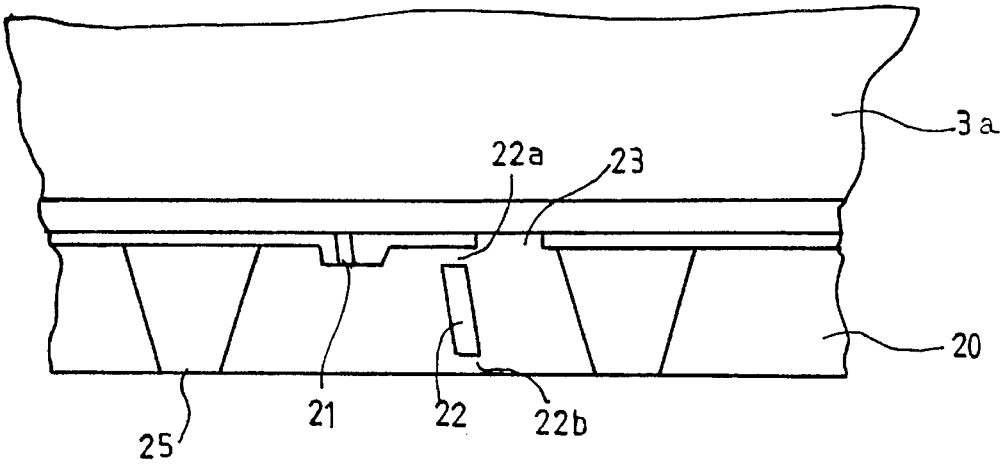
FIG. 3 is a side view of a detail of the cap.
Figure 2:
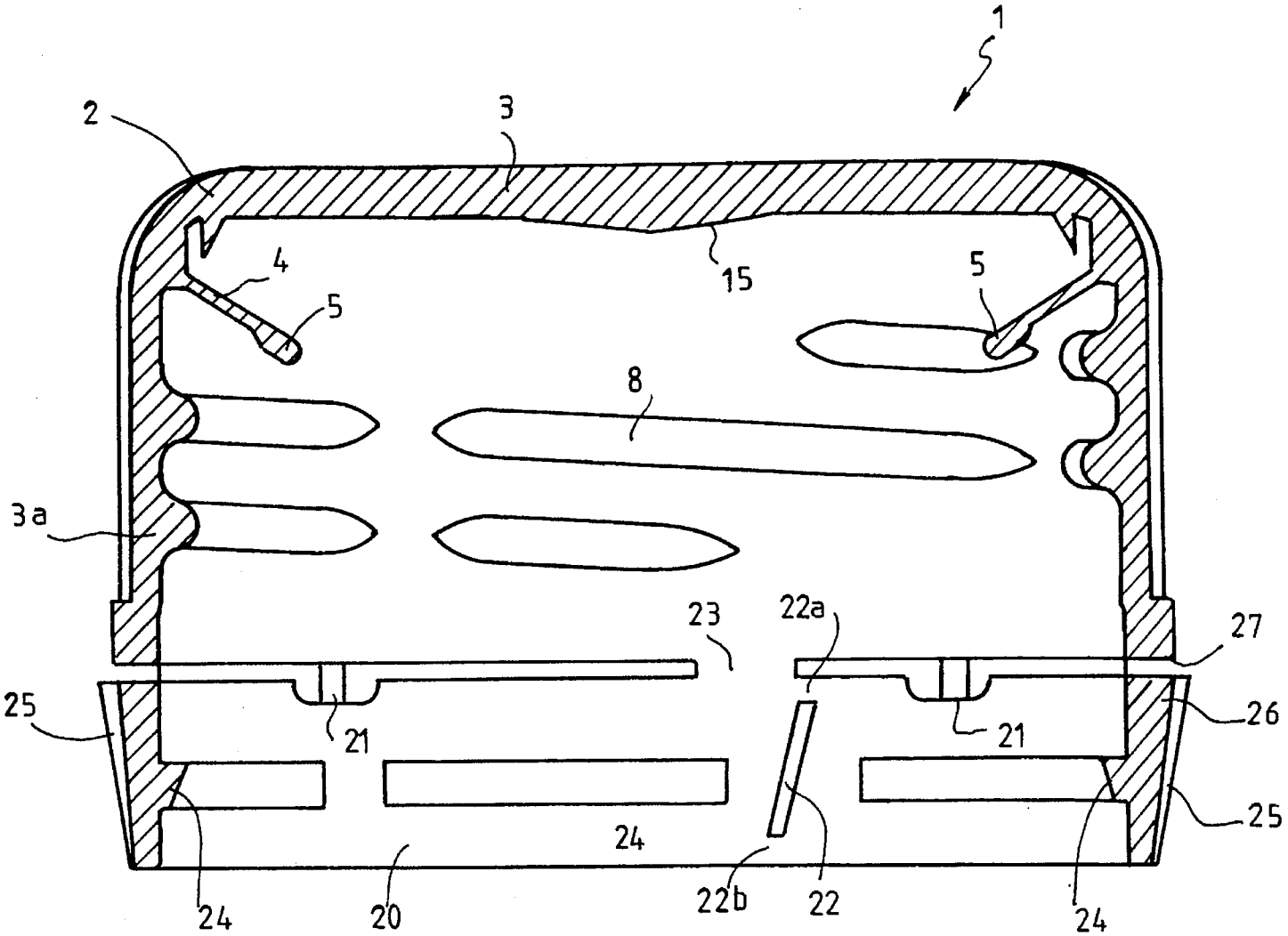
FIG. 2 is a vertical section through the cap.
Figure 4:
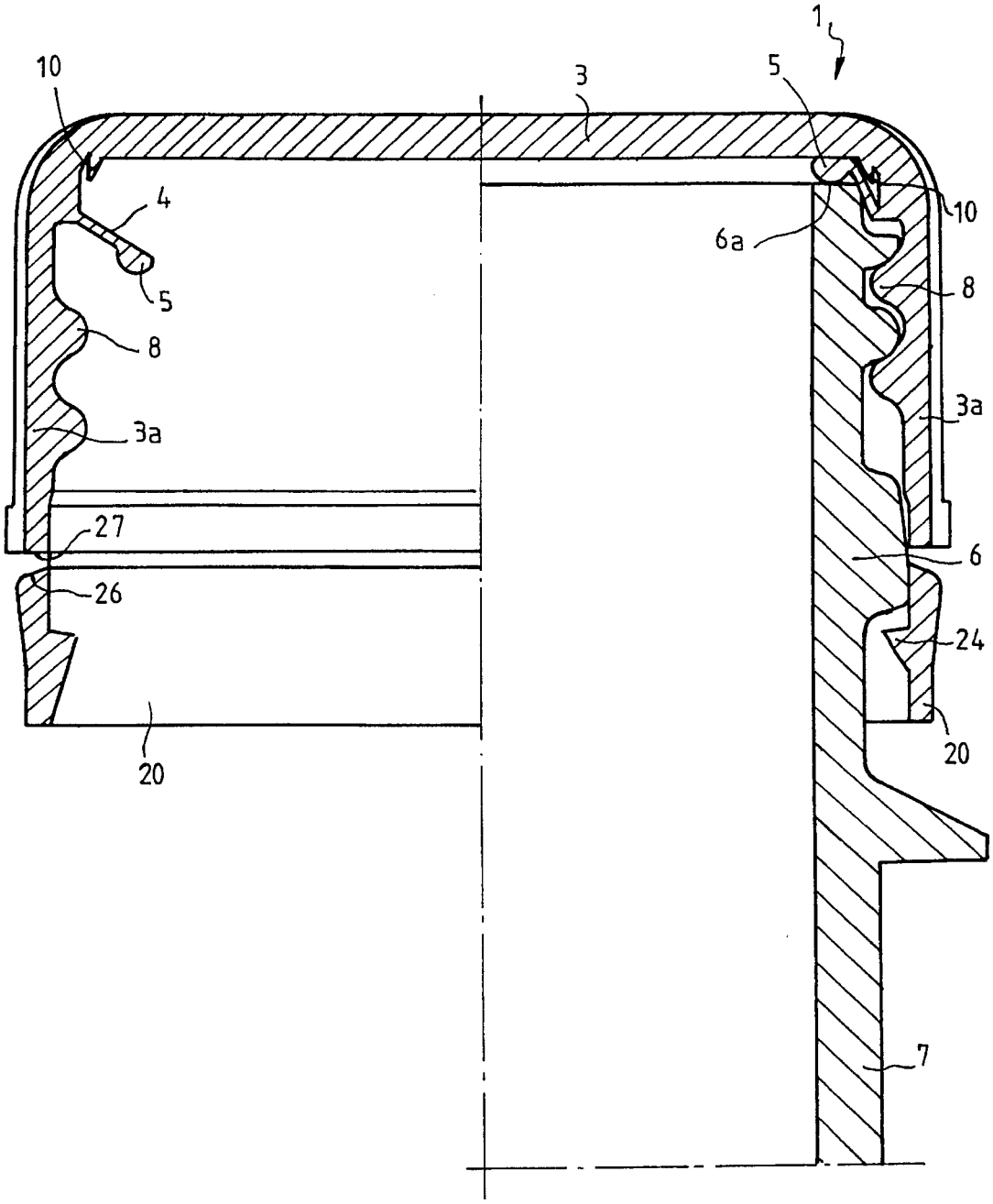
FIGS. 4 and 5 are vertical sections through the cap before and after installation.

As seen in FIGS. 1 through 3 a bottle cap 1 according to the invention has a cup-shaped body 2 formed of a durable and flexible plastic such as polypropylene or polyethylene and an antitamper ring 20 formed unitarily with the body 2. This cap 1 is adapted to fit as seen in FIGS. 4 through 7 on a neck 6 of a bottle 7. The neck 6 has an annular and planar end or mouth surface 6*a* and is formed externally with a screwthread 6*b*.

The cap 1 is centered on an axis A and has a circular end wall 3 from whose outer periphery extends a cylindrical skirt 3*a* internally formed with screwthread elements 8 complementary to the screwthread 6*b* of the neck 6. The end wall 3 is formed centrally with a pyramidal bump 15 that reinforces it.

Unitarily formed with the body 3 is a flexible and thin annular web 4 whose outer periphery is joined to the skirt 3*a* at its upper end and whose inner periphery is unitarily formed with a thick bead forming a seal ring 5. The outer periphery of the end wall 3 is in turn internally formed with an annular triangular-section lip 10 that can engage the web 4 as described below.

The antitamper ring 20 is connected to a lower edge 27 of the skirt 3*a* by a plurality of relatively thin and frangible breakaway tongues or webs 21 and by a single somewhat sturdier tongue or web 23. Internally the ring 20 is formed with radially inwardly projecting and angularly extending ridges 24 of right-triangular section each of whose steep flank is directed back at the end wall to engage under a radially outwardly projecting ridge 6*c* of the neck 6. In addition the ring 20 is formed with an oblique radially throughgoing slot 22 (FIG. 3) that defines two small circumferentially extending webs 22*a* and 22*b*. To ease mounting the cap 1, the ring 20 is formed on its outer surface with triangular reinforcement blocks 25 whose wide ends 26 are directed upward toward the lower edge 27 of the skirt 3*a* so that when, for instance, an automatic machine pushes the cap 1 down on the bottle 7 these blocks 25 will brace the antitamper ring against the body 2.

Figure 5:
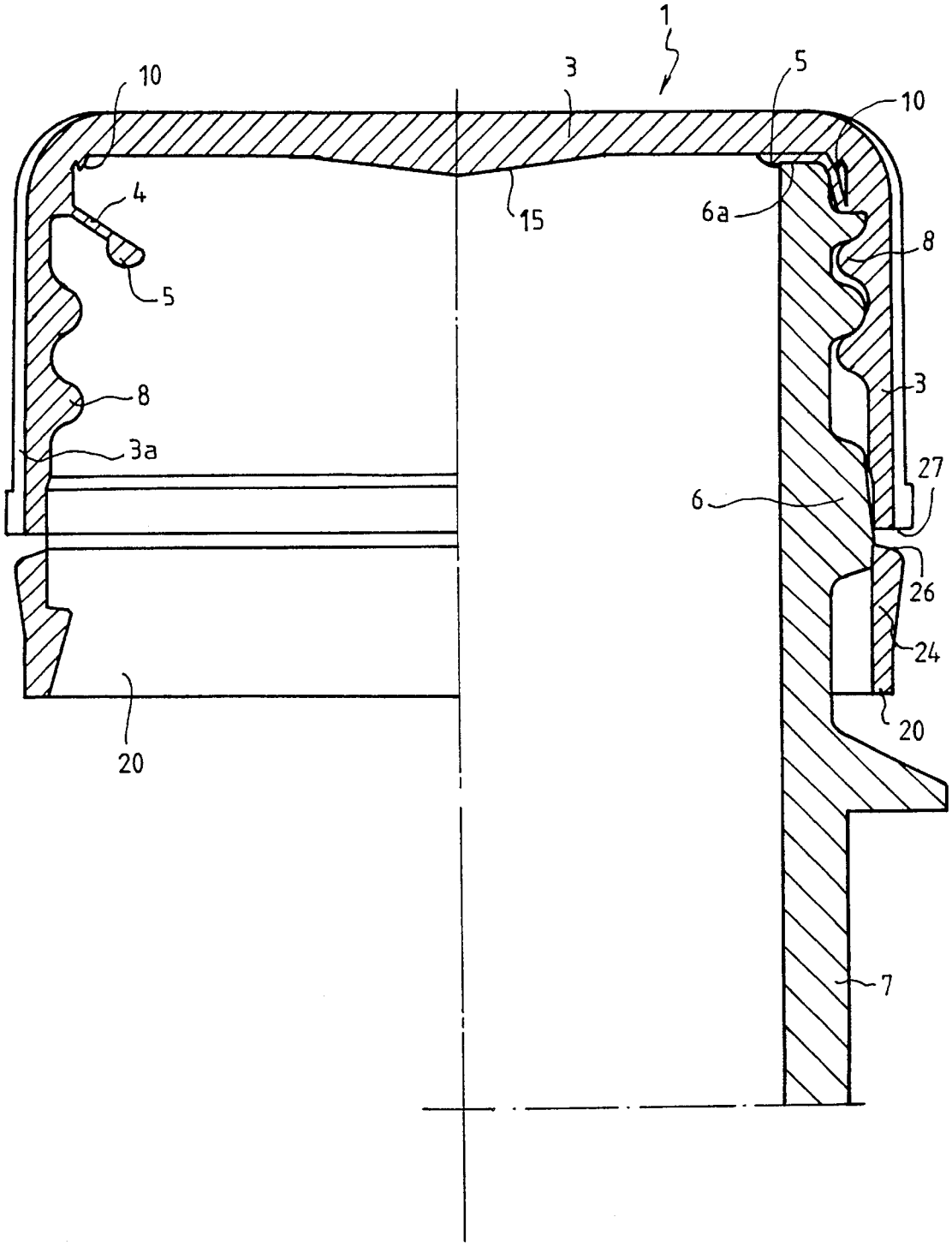

When the cap 1 according to this invention is fitted to a bottle 7, the mouth surface 6*a* will normally engage the seal 5 and compress it as shown in FIG. 5 against the lower face of the end wall 3. This forms a very tight seal that can hold even against a pressure of several bar which is present in a bottle of carbonated beverage, for instance. The lip 10 will engage on top of the web 4 to further increase the sealing effect by pressing this web 4 against the rim of the neck 6.

If the size of the surface 6*a* varies somewhat so that it engages the web 4 as shown in FIG. 7, a tight seal will still be formed. Thus the cap 1 according to this invention can fit bottles 7 of somewhat varying dimensions without leaking. The cap shown here is for a 28 diameter, although it could as easily be used with a 32, 38, or 40 size, according to the standards of BPF, MCA, ALCOA, 1716, and Light-Weight.

As the cap 1 is installed the ridges 24 will snap over the ridge 6*c*, retaining it in place. For removal the entire cap 1 is rotated, backing off the body part 2 while the antitamper ring 20 remains caught under this ridge 6*c*. The axial upward force will eventually rupture the webs 21 and the webs 22*a* and 22*b*, but the web 23 will not break so that the broken ring 20 will remain connected to the cap body 2 when it is free of the bottle 7. Thus this ring 20, which is frequently of a different resin from the bottle, is in fact removed from the bottle to make recycling it easier. The ring 20 can be discarded with the body 2 or the user can twist it free, breaking the web 23, if the body 2 is to be put back on the bottle neck 6.

I claim:

1. In combination with a bottle having a tubular neck formed with an external screwthread and terminating at an annular rim surface having an outside diameter, a cap comprising:

a cup-shaped body generally centered on an axis and formed unitarily with an end wall generally perpendicular to the axis, an annular skirt projecting axially downward from the end wall, an internal screwthread in the skirt matable with the screwthread of the bottle neck, a flexible and thin annular web having an outer periphery joined to the skirt adjacent and spaced from the end wall and an inner periphery, a thick seal ring secured to the inner periphery of the web, the web and seal ring being dimensioned to engage the rim surface when the cap is threaded onto the neck, and an annular lip projecting axially downward from the end wall immediately adjacent the skirt radially outside the seal ring and engageable with the web only radially outward of the seal ring between the seal ring and the skirt, the lip having a diameter greater than the outside diameter of the rim surface, whereby when the neck is screwed fully into the cap its rim surface crushes the seal ring directly against the end wall and compresses the lip with the web; and an antitamper ring secured to a lower end of the skirt.

2. The bottle cap defined in claim 1 wherein the antitamper ring is formed externally with a plurality of reinforcement blocks generally equiangularly spaced about the axis.

3. The bottle cap defined in claim 2 wherein the reinforcement blocks are wedge-shaped and taper away from the end wall.

4. The bottle cap defined in claim 1 wherein the antitamper ring is formed with a throughgoing slot extending obliquely of the axis.

5. The bottle cap defined in claim 4 wherein the slot extends most of an axial dimension of the antitamper ring and this antitamper ring is formed to each side of the slot with a thin material web that ruptures on removal of the cap.

6. The bottle cap defined in claim 1 wherein the cap is formed with:

a plurality of relatively weak connecting tongues extending axially between the antitamper ring and the skirt and dimensioned to rupture on removal of the cap, and a single relatively strong connecting tongue extending axially between the antitamper ring and the skirt and dimensioned not to rupture on removal of the cap, whereby the strong tongue keeps the antitamper ring with the body.

* * * * *